US007135633B2

(12) United States Patent
Miyajima et al.

(10) Patent No.: US 7,135,633 B2
(45) Date of Patent: Nov. 14, 2006

(54) PEDAL LOCKING DEVICE AND PEDAL DEVICE

(75) Inventors: Hideyuki Miyajima, Seto (JP); Naoki Sato, Seto (JP); Kuniaki Okuno, Seto (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 67 days.

(21) Appl. No.: 10/881,403

(22) Filed: Jun. 30, 2004

(65) Prior Publication Data

US 2005/0109192 A1 May 26, 2005

(30) Foreign Application Priority Data

Nov. 20, 2003 (JP) ..... 2003-391008

(51) Int. Cl.
*G10D 13/02* (2006.01)

(52) U.S. Cl. ..... 84/422.1; 84/72

(58) Field of Classification Search ..... 84/422.1, 84/72, 225–226, 312 P, 366, 353, 357, 426, 84/444

See application file for complete search history.

(56) References Cited

U.S. PATENT DOCUMENTS

| | | | | |
|---|---|---|---|---|
| 4,730,532 | A | 3/1988 | Bauerfeind | |
| 6,002,076 | A * | 12/1999 | Karn | 84/422.1 |
| 2003/0094089 | A1 * | 5/2003 | Sato | 84/422.3 |

* cited by examiner

*Primary Examiner*—Lincoln Donovan
*Assistant Examiner*—Jianchun Qin
(74) *Attorney, Agent, or Firm*—Ostrolenk, Faber, Gerb & Soffen, LLP

(57) ABSTRACT

A pedal is switched between a normal position and a low position, which is reached by depressing the pedal downward from the normal position with toes of a foot of a user. A pedal locking unit switches the pedal between a locked state in which the pedal is locked at the low position and an unlocked state in which the pedal is released from the locked state. A lock switch plate switches the pedal locking unit to the locked state. An unlock switch plate releases the pedal from the locked state of the pedal locking means. The lock and unlock switch plates are located beside the pedal to be operable by a heel of the foot.

18 Claims, 10 Drawing Sheets

126
92
92b
92a
Fs
107
106
133
125
93
55
66
84
105
119
103
104
98
(115)
90
113
Fh (a)

(b)

(c)

PEDAL LOCKING DEVICE AND PEDAL DEVICE

BACKGROUND OF THE INVENTION

The present invention relates to a pedal locking device and pedal device for locking a foot-depressed pedal at a low position.

In conventional percussion instruments, for example high hat stands and the like, there are known pedal locking devices for maintaining a pedal at a foot-depressed position. In general, high hat stands are incorporated in a drum set and include two cymbals arranged one on top of the other. A pedal is moved upward and downward to close and open the two cymbals. Unique tonal qualities are produced when the two cymbals are closed together and struck while the pedal is depressed. However, when the drum set has two bass drums and twin pedals, a total of three pedals are used, two pedals for operating the drums and one pedal for operating the high hat stands. Since the high hat stand pedal cannot be operated at the same time as when operating the two drum pedals, the cymbals are maintained in the opened position. However, there may be times when the musician desires to play the high hat stands while the cymbals are in the closed state, that is, when the foot-depressed pedal is located at a low position.

U.S. Pat. No. 4,730,532 describes a device having a function for locking a pedal so as to allow the high hat stands to be maintained in the closed state. The device described in the US Patent is provided with a stationary member 150, which functions as a guide post, and a movable member 151, which is slidable on the stationary member 150, as shown in FIG. 11. A spring 152 is arranged on the outer surface of the movable member 151. The stationary member 150 is supported on a U-shaped frame 153. The frame 153 is mounted on a high hat stand guide column 155 by means of mounting members 154*a* and 154*b*. The frame 153 is provided with an anchor plate 156 through which extends the movable member 151. A tiltable plate 158, which has a hole, is arranged between the anchor plate 156 and an arm 157 on the bottom end of the frame 153.

A compression spring 159 is arranged between the plate 158 and the arm 157. A slight gap is provided between plate 158 and the movable member 151 in the hole of the plate 158. Accordingly, the movable member 151 is forced upward by the spring 152. The plate 158 prevented from the movable member 151 from being raised unintentionally. Therefore, the movable member 151 is stopped at any position.

In this device, an operation pedal 160 is depressed to hold the cymbals in a closed state. This lowers the movable member 151 as it slides along the outer surface of the stationary member 150 and compresses the spring 152. The plate 158 functions to keep the movable member 151 anchored at the lowered position. In this state, a foot pedal 161 is pressed downward by the lowered movable member 151. This closes the pair of cymbals and locks the foot pedal 161 at the foot-depressed position (low position).

When unlocking the foot pedal 161, the plate 158 is depressed downward to release the movable member 151. This enables the movable member to move through the hole of the plate 158. The force exerted by the spring 152 lifts the movable member 151. Thus, the downward pressing force on the foot pedal 161 is eliminated to unlock the foot pedal and open the cymbals.

In the conventional device, when the cymbals are locked in the closed state, the joined cymbals produce a somewhat combined noise. Furthermore, since the cymbals automatically return to the open state when released from the locked state, it is impossible to continue playing the cymbals in the closed state after releasing the lock. This is because the pedal locking and unlocking operations cannot be performed when the pedal is being depressed.

Furthermore, a constant tonal quality cannot be reproduced because the tone of the cymbals changes each time the cymbals are locked in accordance with changes in the pressure applied by the operation pedal 160 when locking the cymbals in the closed state.

BRIEF SUMMARY OF THE INVENTION

It is an object of the present invention to provide a pedal locking device and pedal device capable of performing a locking operation and an unlocking operation in a state in which the pedal is being depressed at a low position.

Another object is to provide a pedal locking device and pedal device capable of stably reproducing a regulated tonal quality each time a locking operation is performed.

To achieve the above objects, the present invention provides a pedal locking device installed on a pedal device provided with a pedal switched between a normal position and a low position, which is reached by depressing the pedal downward from the normal position with toes of a foot of a user. The pedal locking device includes a means for locking the pedal and switched between a locked state in which the pedal is locked at the low position and an unlocked state in which the pedal is released from the locked state. An operating means includes a lock operation unit for switching the pedal locking means to the locked state and an unlock operation unit for releasing the pedal from the locked state of the pedal locking means. The operating means is located beside the pedal to be operable by a heel of the foot.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENT

A pedal locking device 50 according to a preferred embodiment of the present invention will now be discussed with reference to FIGS. 1 to 10. The pedal locking device 50 is embodied in a pedal device of a high hat stand 11.

Figure 1:
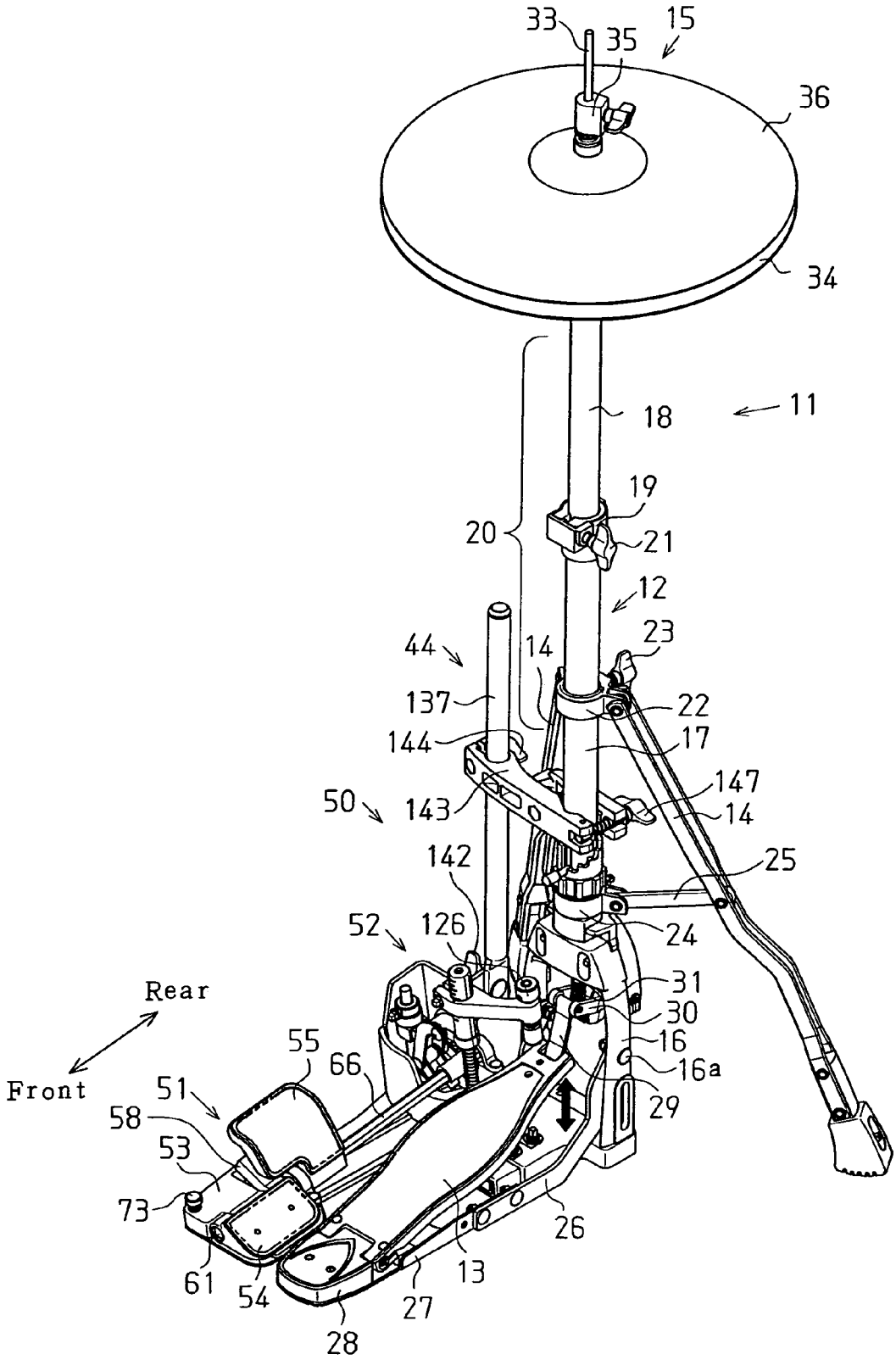
FIG. 1 is a perspective view showing a pedal locking device, mounted on a high hat stand, according to a preferred embodiment of the present invention.
Figure 2:
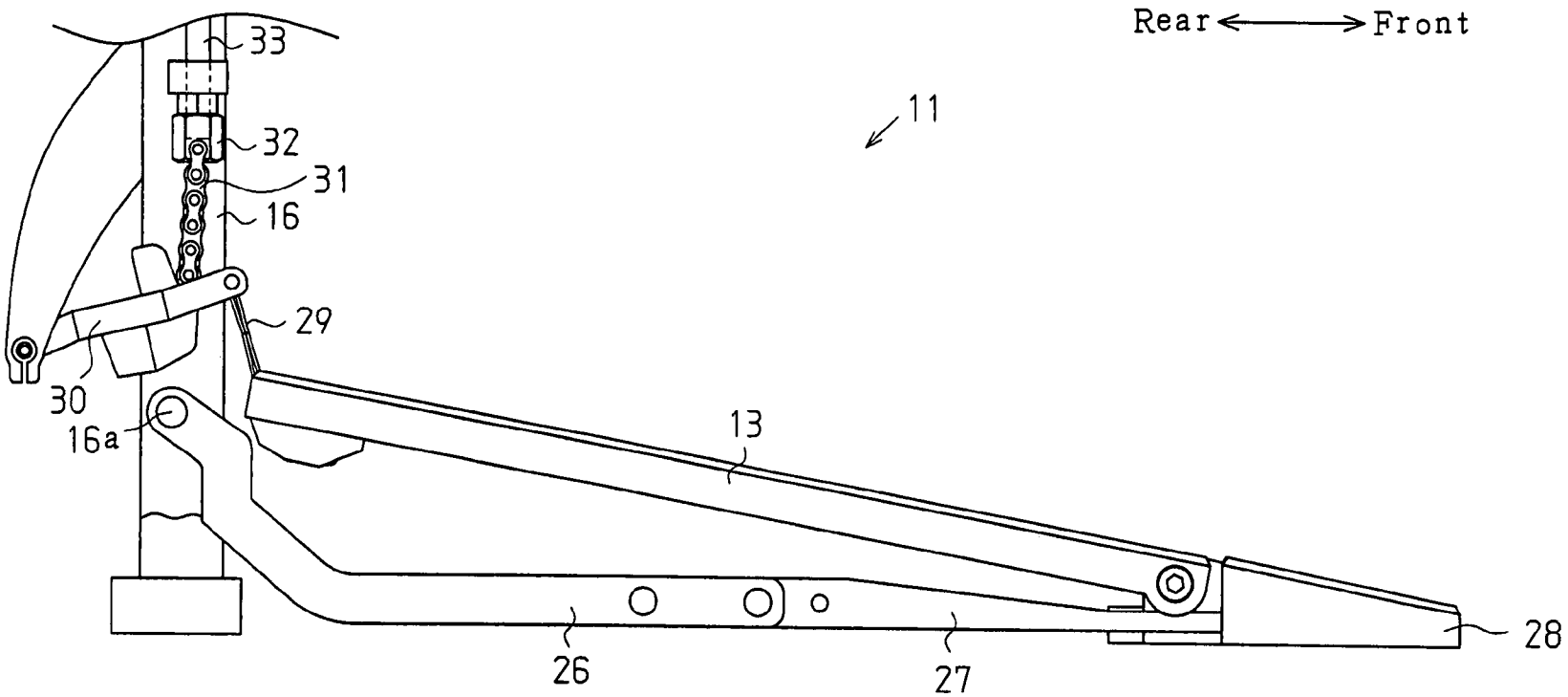
FIG. 2 is a side view showing a foot pedal of the high hat stand.

As shown in FIG. 1, the pedal locking device 50 is mounted on the lower part of a high hat stand 11. FIG. 1 shows two cymbals 34 and 36 of a cymbal unit 15 in a separated state (hereinafter referred to as "cymbal open state"). In this state, the locking operation may be performed. Furthermore, as shown in FIG. 2, a foot pedal 13 is arranged in front of the high hat stand 11. The foot pedal 13 includes a portion on which the toes of a musician rest (hereinafter referred to as "toe rest portion") and a portion on which the heel of the musician rests (hereinafter referred to as "heel rest portion"). The musician depresses the pedal 13 with his or her toes to move the pedal 13 from a normal position to a low position, which is below the normal position.

As shown in FIG. 1, the high hat stand 11 is provided with a stand body 12, and the foot pedal 13 is located at the lower portion of the stand body 12. Two legs 14 extend from the lower portion of the stand body 12. The cymbal unit 15 arranged at the upper portion of the stand body 12. Viewed from the front, the stand body 12 is provided with a square gate frame 16, a lower pipe 17, and an upper pipe 18.

The bottom end of the upper pipe 18 is inserted inside the lower pipe 17. A length adjustment mechanism 19 attached to the top end of the lower pipe 17 fastens the upper pipe 18 to the lower pipe 17. The lower pipe 17 and the upper pipe 18 form a pipe member 20. The length adjustment mechanism 19 includes a lock nut 21. When the lock nut 21 is loosened, the upper pipe 18 is movable in a vertical direction relative to the lower pipe 17. This enables the length of the pipe member 20 to be adjustable.

An upper support 22 is fixed to the middle of the lower pipe 17 at a preferred position by a lock nut 23. The top ends of the two legs 14 are pivotally supported in the upper support 22. Furthermore, a lower support 24 is fixed to the lower pipe 17 above the gate frame 16. Three stays extend between the lower support 24 and the legs 14. One end of each stay 25 is pivotally supported by the lower support 24, and the other end of each stay 25 is pivotally connected to the generally middle portion of an associated one of the legs 14.

The lower fixed cymbal 34 is fixed to the top end of the upper pipe 18. A cymbal operating rod 33 is inserted through the lower fixed cymbal 34. The upper movable cymbal 36 is mounted on the top end of the cymbal operating rod 33 by means of a mounting member 35. The lower fixed cymbal 34 and the upper movable cymbal 36 form the cymbal unit 15. The upper movable cymbal 36 is joined with and separated from the lower fixed cymbal 34 by the vertical movement of the toe rest portion defined on the foot pedal 13 when the foot pedal 13 is operated.

As shown in FIG. 2, a fixed portion 16*a* is defined at the generally middle part of the gate frame 16. A connecting arm 26, which extends toward the front, is attached to the fixed portion 16*a*. A heel rest 28 is fixed to the front of the connecting member 27. The heel rest 28, the connecting member 27, and the connecting arm 26 are integrally formed with the foot pedal 13. The fixed portion 16*a* is pivotally supported. A belt 29, which extends upward, is connected to the rear end of the foot pedal 13. A chain 31 is linked to the foot pedal 13 by the belt 29 and an arm 30. An upper portion of the chain 31 is connected to the bottom end of the cymbal operating rod 33 by a nut 32. The cymbal operating rod 33 is inserted through the lower pipe 17 and the upper pipe 18 so that the top end protrudes from the upper pipe 18, as shown in FIG. 1.

Figure 3:
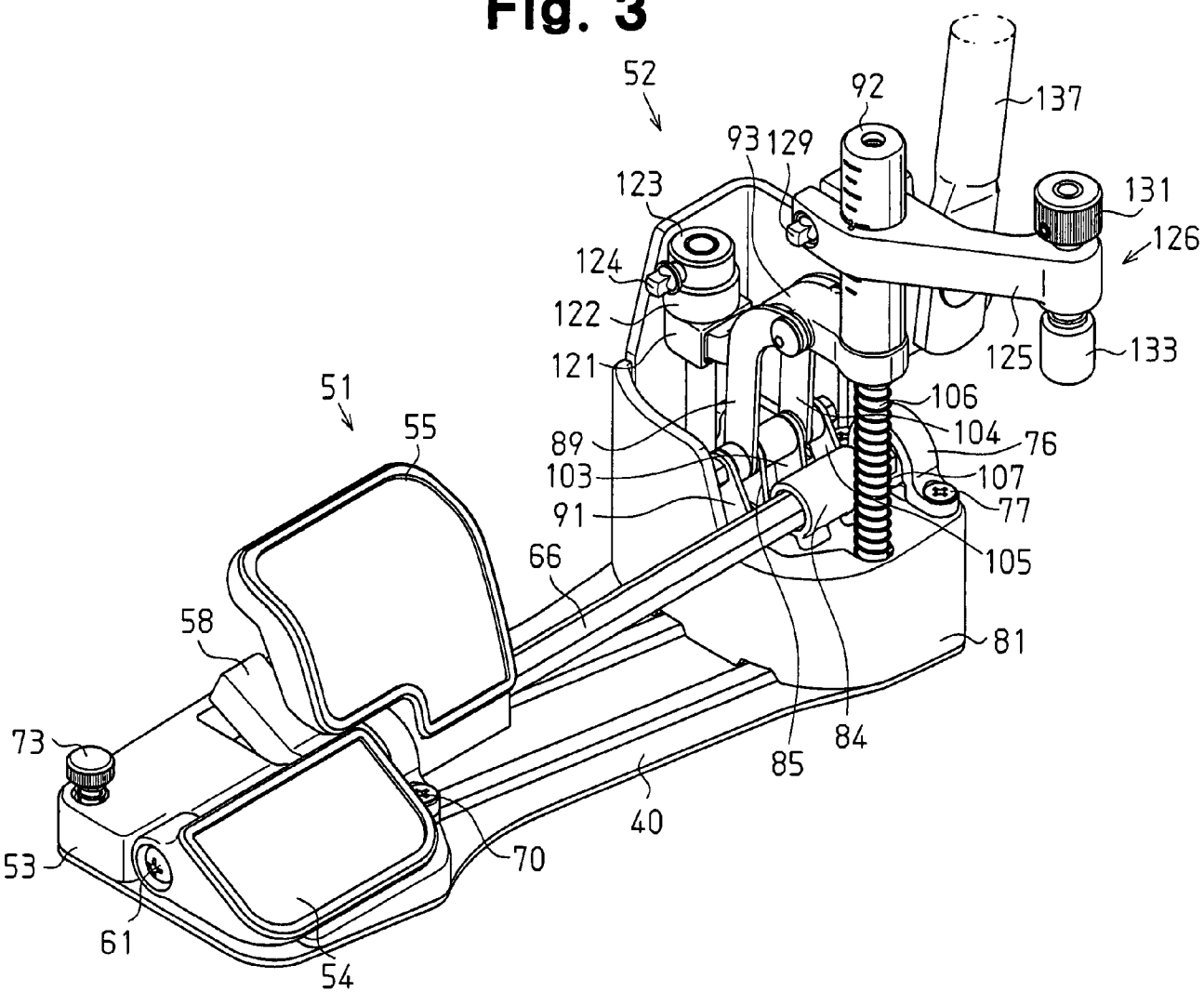
FIG. 3 is a perspective view showing a pedal locking unit and an operation unit in the pedal locking device.
Figure 4:
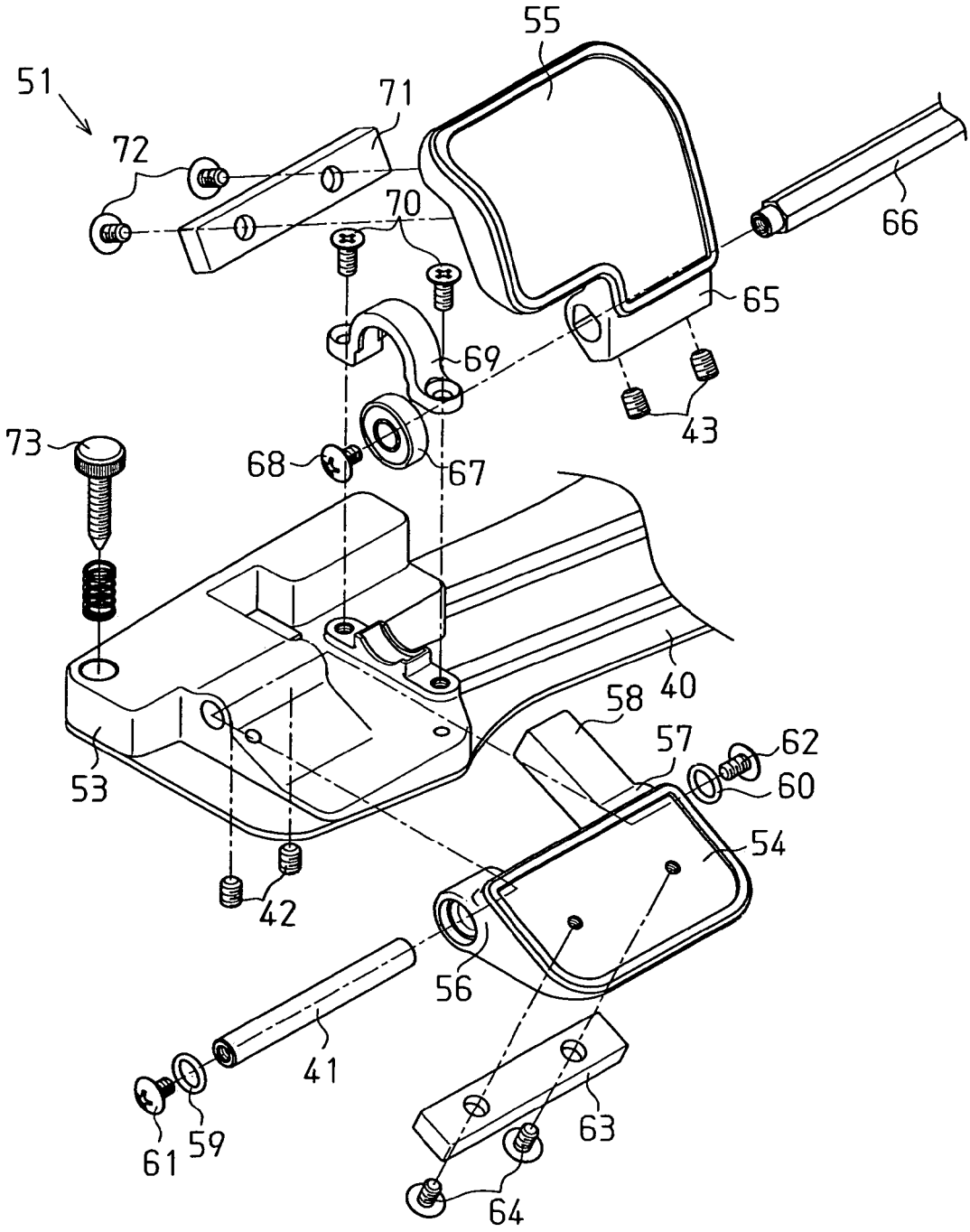
FIG. 4 is an exploded perspective view showing the operation unit.
Figure 5:
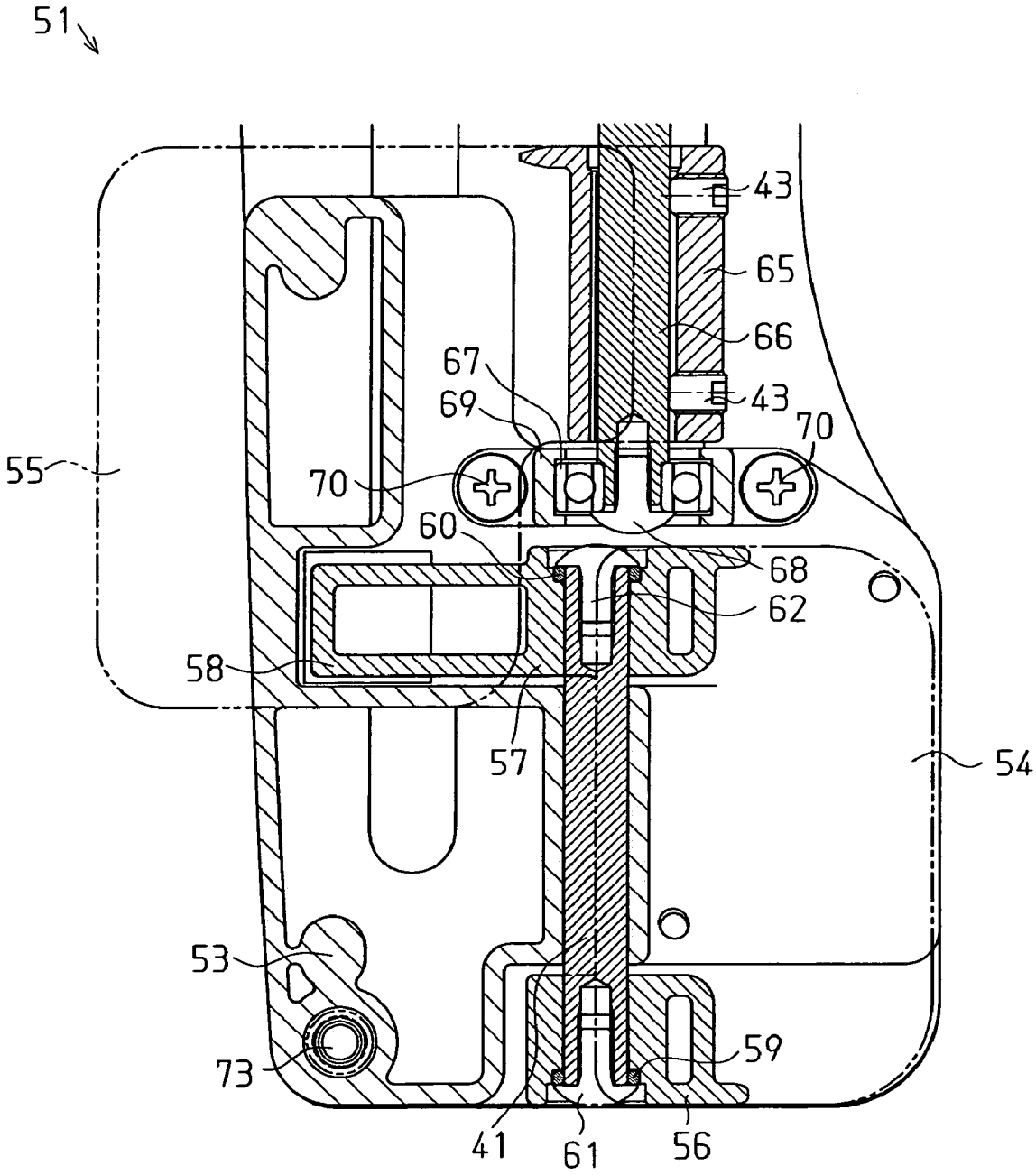
FIG. 5 is a schematic plan view showing the operation unit.

The various parts of the pedal locking device 50 will now be described. FIG. 3 is a perspective view showing the lower portion of the pedal locking device 50, that is, an operation unit 51 and pedal locking unit 52. FIG. 4 is an exploded view showing the operation unit 51. FIG. 5 is a cross sectional plan view of the operation unit 51 in a locked state.

As shown in FIG. 1, a pedal locking device 50 is arranged on the side (left side in the drawing) of a high hat stand 11. The side of the high hat stand 11 on which the pedal locking device 50 is positioned is referred to as the left side in the following description. As shown in FIG. 3, the pedal locking device 50 includes a pedal locking unit 52 for setting the foot pedal 13 in a locked state, an operation unit 51 for locking and unlocking the foot pedal 13, and a mounting unit 44 for connecting the pedal locking device 50 to the high hat stand 11. The mounting unit 44 corresponds to a mounting means in the present invention.

As shown in FIG. 4, the operation unit 51 is provided with an operation base 53 fixed to a base plate 40 by screws (not shown). An unlock switch plate 54 and a lock switch plate 55 are provided on top of the operation base 53. An anchor bolt 73 is screwed through the base plate 40 and operation base 53 on the front left end of the operation base 53. The anchor bolt 73 is rotated so that the tapered end protrudes from the bottom surface of the base plate 40 to contact the ground surface and prevent the pedal locking device 50 from sliding on the ground surface.

The unlock switch plate 54 is rectangular. Shaft sleeves 56 and 57 having shaft holes extending in the longitudinal direction of the unlock switch plate 54 are formed at the left side of the unlock switch plate 54. A contact piece 58 protrudes from the rear shaft sleeve 57 toward the left. A support shaft 41 is inserted through the shaft sleeves 56 and 57 and a shaft hole provided on the operation base 53. The two ends of the support shaft 41 are fastened to the shaft sleeves 56 and 57 by a pair of screws 61 and 62 and a pair of washers 59 and 60. Furthermore, the support shaft 41 is fixed to the operation base 53 by two screws 42 when the support shaft 41 is inserted through the shaft hole, which is located at the middle of the front portion of the operation base 53. The unlock switch plate 54 is supported by the support shaft 41. The unlock switch plate 54 is pivotal by a predetermined angle around the support shaft 41.

A rubber member 63, which functions as a buffer member for the operation base 53, is attached by two screws 64 to the bottom surface of the unlock switch plate 54. In the open cymbals state shown in FIG. 1, the weight of the unlock switch plate 54 causes the unlock switch plate 54 to be lowered to a position at which the rubber member 63 contacts the operation base 53. At this position, the unlock switch plate 54 does not hinder normal pedal operation of the high hat stand 11. Furthermore, in the open cymbals state, the contact piece 58 of the unlock switch plate 54 is arranged at an angle of approximately 20 degrees relative to the right side of the base plate 40, and the tip of the contact piece 58 is in a state separated from the operation base 53.

As shown in FIGS. 4 and 5, the lock switch plate 55 is a generally square plate-like pedal having a notch in one corner (bottom right side in FIG. 5). A connecting piece 65 extends integrally from the lock switch plate 55 (from the right side as viewed in FIG. 5). The lock switch plate 55 is fixed by two screws 43 to an operation shaft 66, which extends longitudinally in the connecting piece 65.

A bearing 67 is fastened to the tip of the operation shaft 66 by a screw 68. Furthermore, a bearing cover 69 is installed on top of the bearing 67. The bearing 67 is fixed to the operation base 53 by two screws 70. Thus, the lock switch plate 55 is pivotally mounted on the operation base 53 by the operation shaft 66. Furthermore, a rectangular rubber member 71 functioning as a buffer member is attached by two screws 72 along the edge (left side edge in FIG. 5) of the lock switch plate 55 on the bottom surface of the lock switch plate 55.

Figure 6:
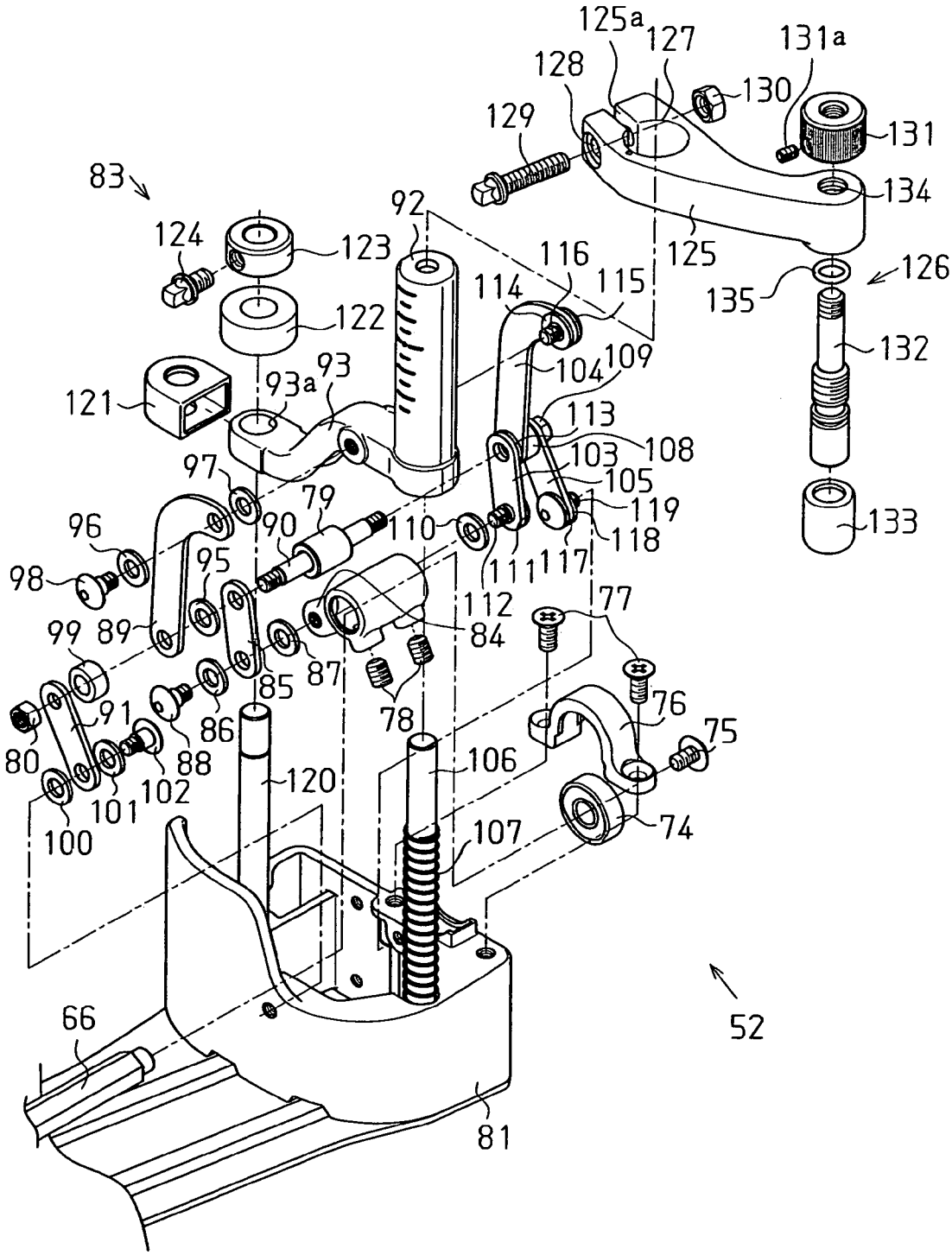
FIG. 6 is an exploded perspective view showing the pedal locking unit.

FIG. 6 is an exploded perspective view showing a pedal locking unit 52. As shown in FIGS. 3 and 6, a link mechanism 83 is provided within the frame 81 of the pedal locking unit 52 to convert the rotational movement of the operation shaft 66 to the vertical movement of a slide member 92. The operation shaft 66 is inserted into a first link 84, which functions as a mounting part for the hexagonal operation shaft 66. A bearing 74 is fastened from the rear by a screw 75 to the rear end of the operation shaft 66. The bearing 74 is located above the frame 81 and is fastened to the frame 81 from above by a bearing cover 76 by two screws 77. Furthermore, the first link 84 is attached to the operation shaft 66 by two screws 78. Thus, the first link 84 is pivotally mounted to the frame 81 by the operation shaft 66.

A first end of a second link 85 is pivotally connected to the front side of the first link 84 by means of a screw 88 and washers 86 and 87, which are located on the front and rear sides of the second link 85. A second end of the second link 85 is connected to the bottom end of a hook-shaped third link 89 by way of a washer 95 located on the front side of the second link 85

The bent upper end of the third link 89 is connected to the front surface of an arm 93, which extends pivotally from the slide member 92, by means of a screw 98 and front and rear washers 96 and 97. A first end of a fourth link 91 is pivotally connected to the front side of the third link 89 by means of a hexagonal nut 80 and a shaft 90, which is inserted through a collar 99. The front end of the shaft 90 is inserted through the second link 85, the third link 89, and the fourth link 91 so that the each of the links 85, 89, and 91 is pivotally connected to the shaft 90. A collar 79 is provided on the shaft 90 at the middle portion of the shaft 90. The second end of the fourth link 91 is pivotally supported on the inner front surface of the frame 81 by a screw 102 with front and rear washers 100 and 101 arranged on each side of the fourth link 91.

The link mechanism 83 of the preferred embodiment includes four links (i.e., the first link 84, the second link 85, the third link 89, and the fourth link 91). An identical link mechanism is provided at the rear side of the slide member 92 so that the link mechanisms are arranged on opposite sides of the slide member 92. That is, a fifth link 103 corresponding-to the second link 85, a sixth link 104 corresponding to the third link 89, and a seventh link 105 corresponding to the fourth link 91 are connected to the rear side of the first link 84. The structure of the link mechanism formed by these links is substantially similar to the previously described link mechanism 83 except in that the structure is a mirror image of the link mechanism 83.

That is, a first end of the fifth link 103 is pivotally connected to the rear side of the first link 84 by means of a screw 112 and washers 110 and 111, which are located on the front and rear sides of the fifth link 103. The rear side of a second end of the fifth link 103 is connected to the bottom end of a sixth link 104 by way of a washer 113. The top end of the sixth link 104 is pivotally supported on the rear surface of the arm 93 of the slide member 92 by means of a screw 116 and front and rear washers 114 and 115. A first end of the seventh link 105 is pivotally connected to the rear bottom end of the sixth link 104 by means of a hexagonal nut 109 and the shaft 90, which is inserted through a collar 108. The rear end of the shaft 90 is inserted through and pivotally connected to the fifth link 103, the sixth link 104, and the seventh link 105. Clearance is provided between outer surface of the shaft 90 and the three collars 99, 79, and 108 so that the collars 99, 79, and 108 are pivotal relative to the shaft 90. Furthermore, the bottom end of the seventh link 105 is pivotally supported on the inner rear surface of the frame 81 by a screw 119 with front and rear washers 117 and 118 on each side of the seventh link 105.

The washers (86, 87, 95, 96, 97, 100, 101, 110, 111, 113, 114, 115, 117, and 118) in the preferred embodiment are made of felt. The screws (88, 98, 102, 112, 116, and 119) are set at a predetermined tightness in accordance with the thickness of the individual washer. The washers are fitted between the screws and the links to enable pivoting while preventing loosening of the screws.

Figure 10:
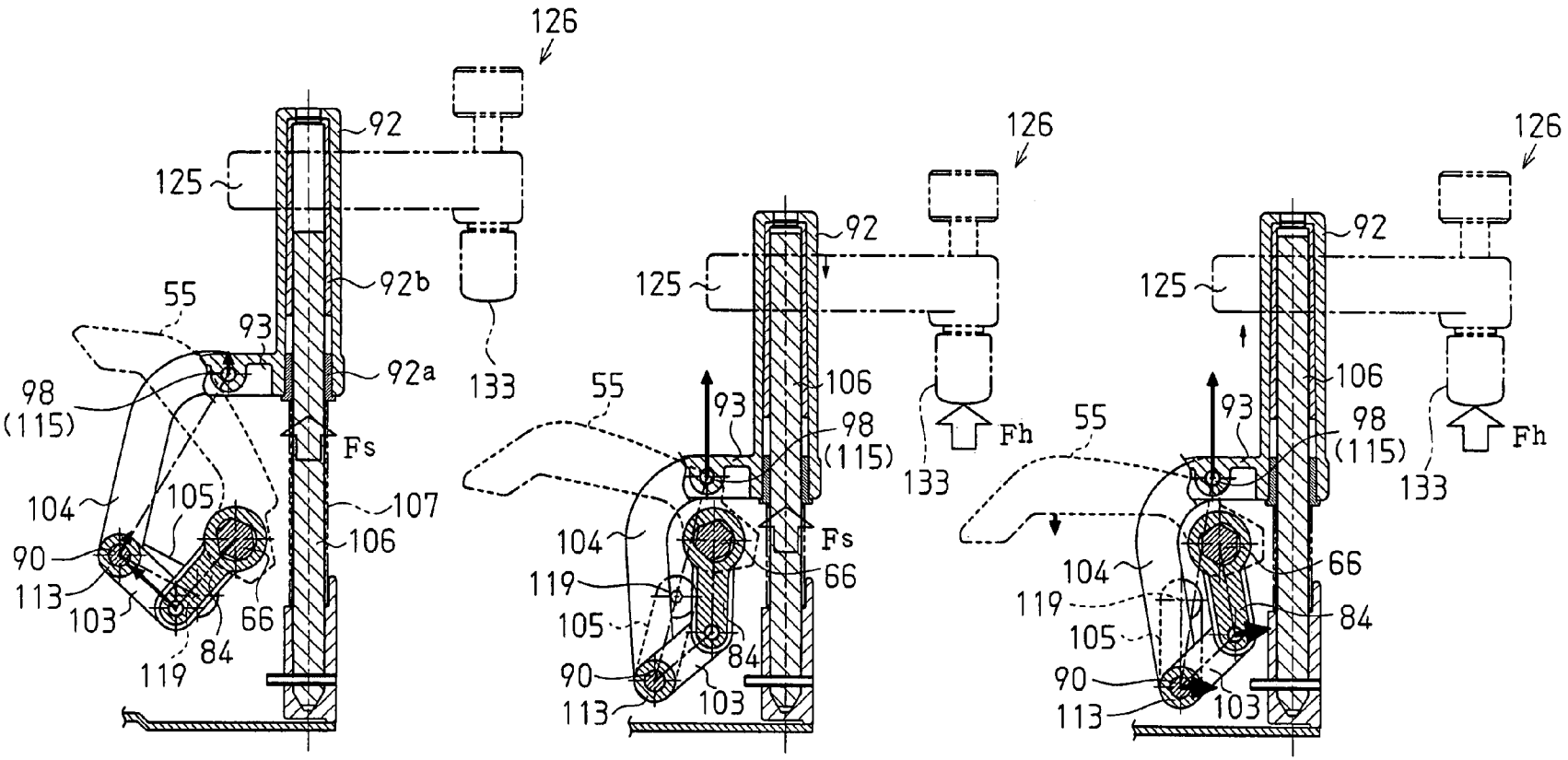
FIGS. 10(*a*), 10(*b*), and 10(*c*) are schematic side views showing a link operation.
Figure 11:
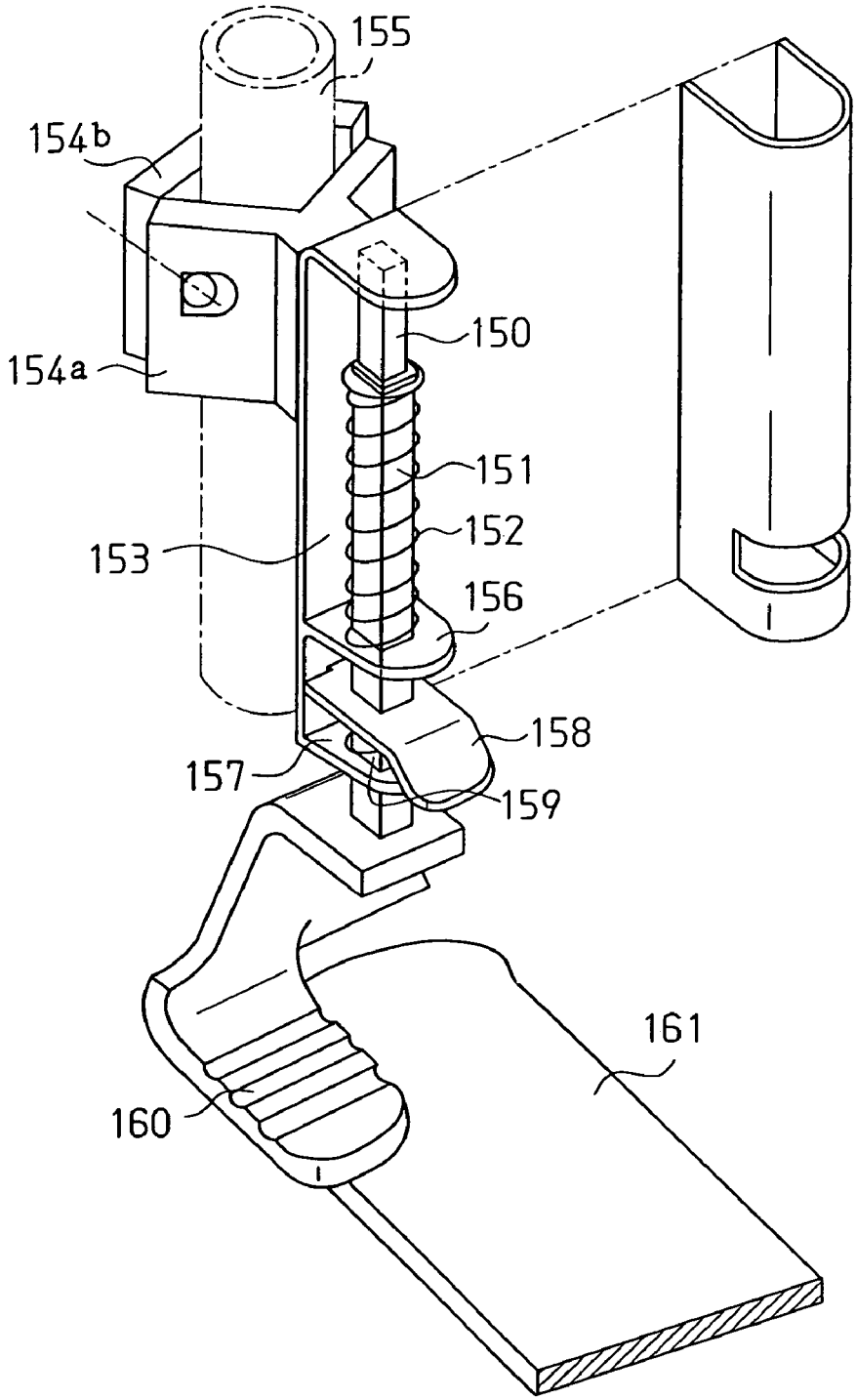
Fig. 11(Prior Art)
FIG. 11 is a perspective view showing a conventional pedal locking device.

The slide member 92 is a thick cylindrical member, connected to the top part of a pole 106 in the frame 81. The interior diameter of the hole of the slide member 92 is set so as to be slightly larger than the external diameter of the pole 106. Bushings 92*a* and 92*b*, which are made of a resins having a low friction coefficient, are installed in the hole of the slide member 92 so that the slide member 92 easily moves relative to the pole 106, as shown in FIGS. 10(*a*) through 10(*c*).

Furthermore, a coil spring 107 engages the pole 106 with a slight clearance provided between the coil spring 107 and the outer surface of the pole 106. The coil spring 107 normally exerts an upward a force on the slide member 92 to upwardly bias each link connected to the slide member 92. Furthermore, when the operation shaft 66 is rotated in the locking and unlocking operations of the pedal 13, the rotation is transmitted to the slide member 92 through the link mechanism 83 such that the slide member 92 moves vertically with the bushings 92*a* and 92*b* in contact with the outer surface of the pole 106.

A hole 93*a* for receiving a shaft 120 extends through the tip of the arm 93, which extends from the slide member 92. A bushing 121 covers the tip of the arm 93. A hole having a diameter slightly larger than the shaft 120 and smaller than the hole 93*a* of the arm 93 is formed in the bushing 121. Furthermore, a buffer member 122 and a stopper 123 provided with a hole for receiving the shaft 120 are arranged at the top part of the bushing 121. The stopper 123 is fixed to the top end of the shaft 120 by a bolt 124. In this way, the arm 93 is movable in a vertical direction along the shaft 120 together with the bushing 121. The buffer member 122 is formed of felt and absorbs impact when the arm 93 is lifted and contacts the stopper 123.

In this structure, when the cymbals are in the opened state, one side (left side in FIG. 5) of the lock switch plate 55 is stationary and held an angle of approximately 65 degrees relative to the base plate 40 by means of the force exerted by the coil spring 107. Furthermore, the position at which the stopper 123 is fixed may be changed in accordance with the amount of foot depression when the musician locks the foot pedal 13 to adjust the amount of vertical movement of the slide member 92. For example, when the amount of foot depression during the locking the foot pedal 13 is small, the position at which the stopper 123 is fixed is set at a low position to decrease the inclination of the lock switch plate 55 relative to the operation base 53.

In FIG. 6, a pedal depressor 126 is provided on the right side of the slide member 92 by means of an arm 125. The pedal depressor 126 is switchable between a standby position, which is above the normal position of the pedal 13, and a lock position. The pedal is moved downward from the standby position to lock the pedal at a low position.

The arm 125 extends laterally, that is, toward the high hat stand 11, from the slide member 92 such that the pedal depressor 126 is arranged above the toe rest portion of the foot pedal 13 when mounted on the high hat stand 11 (refer to FIG. 1). A slit 125*a* is formed on the basal end of the arm 125, and a pair of grips 127 are defined on opposite sides of the slit 125*a*. The grips 127 hold the slide member 92. A hole 128 passes through the slit 125*a*. In this way when the slide member 92 is held by the grips 127, the slit 125*a* is compressed by inserting a bolt 129 into the hole 128 and forcibly tightening the bolt 129 and a nut 130 so as to fix the arm 125 at position of optional height on the slide member 92. The height of the pedal depressor 126 is adjusted by changing the fixed position of the arm 125.

The pedal depressor 126 has a screw hole 134 formed in the tip of the arm 125. A female-threaded adjustment knob 131 is arranged on the top side of the arm 125. An adjustment bolt 132 and a resin cap 133, which is fitted to the adjustment bolt 132, are provided on the lower side of the arm 125. A male thread is formed on the adjustment bolt 132 in correspondence to the female thread of a screw hole in the arm 125 and the adjustment knob 131. The adjustment bolt 132 is attached to the arm 125 by screwing the bolt 132 into the screw hole 134 of the arm 125 from the bottom side of the arm 125 with an O-ring 135 arranged in between.

The adjustment knob 131 is fixed to the adjustment bolt 132 by a screw 131*a*. The musician adjust the amount of engagement of the adjustment bolt 132 and the screw hole 134 by rotating the adjustment knob 131 with his or her fingers to rotate the adjustment bolt 132. The height of the bottom end surface (bottom end surface of the cap 133) of the pedal depressor 126 is changed in accordance with the amount of rotation of the adjustment bolt 132. In this way, the height of the pedal depressor 126 is finely adjusted by rotating the adjustment knob 131. Further, the height of the foot pedal 13 may be kept constant whenever a locking operation is performed. Accordingly, the closing pressure of the cymbals during the locking operation can be finely adjusted, a desirable tonal quality can be finely adjusted, and the adjusted tonal quality may be stably reproduce whenever the locking operation is performed. The pedal depressor 126 and the arm 125 correspond to a height adjustment mechanism of the present invention.

Figure 7:
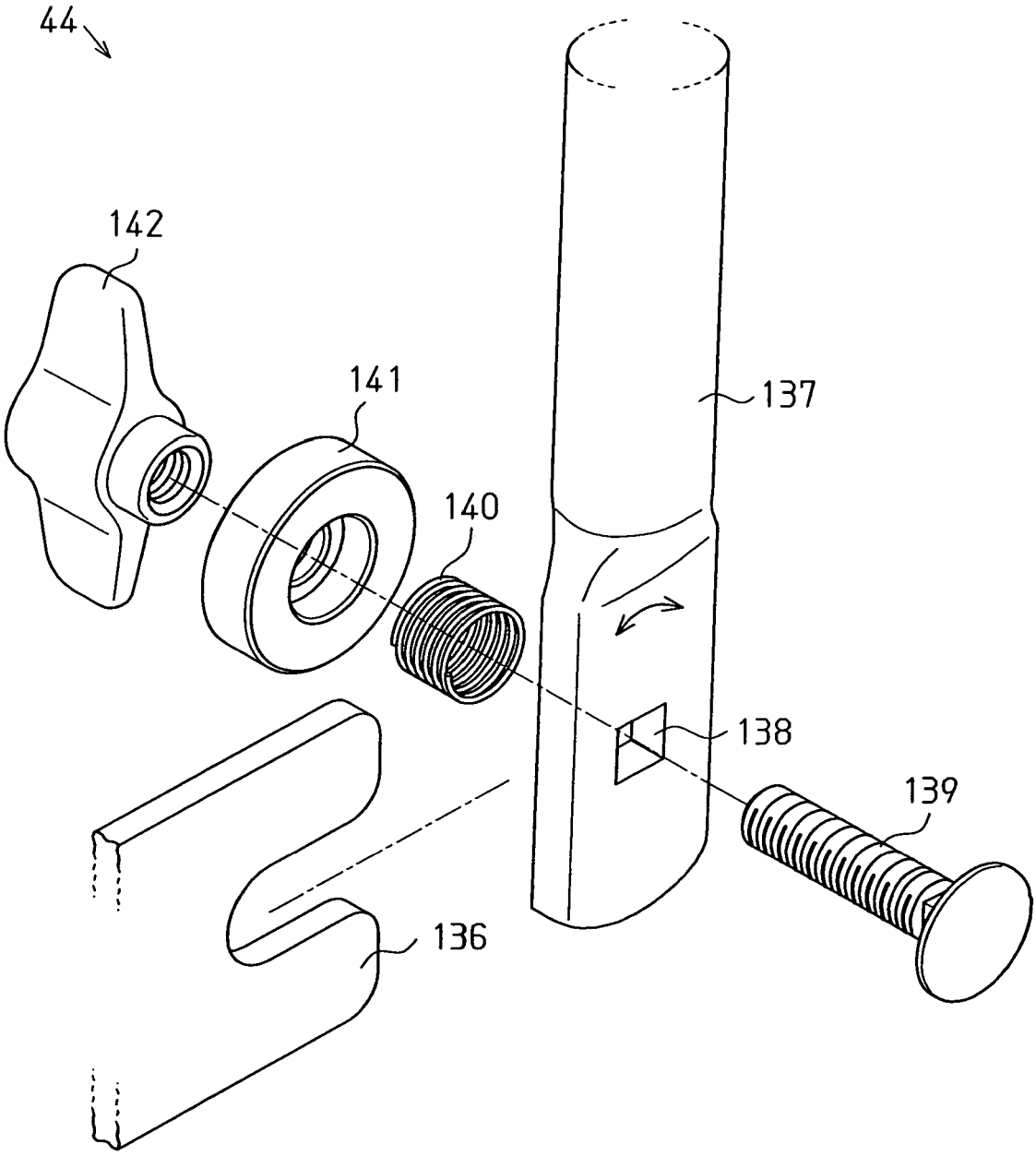
FIG. 7 is an exploded perspective view showing a connection portion of the mounting unit and the pedal locking unit.

The structure of the mounting unit 44 connecting the pedal locking device 50 to the high hat stand 11 will now be described. FIG. 7 is an exploded perspective view showing the lower part of the mounting unit 44 and, particularly, the connection with the pedal locking unit 52.

The mounting unit 44 shown in FIG. 1 is provided with a joint pipe 137, or a support column, the lower portion of which is plate-shaped. The joint pipe 137 is connected to a joint plate 136 fixed to the rear part of the pedal locking unit 52, as shown in FIG. 7. A notch is formed at the tip of the joint plate 136, and a hole 138 is formed at the bottom end of the joint pipe 137. The joint pipe 137 is fastened to the pedal locking unit 52 from the rear by inserting a bolt 139 into the hole 138, and screwing a T-nut 142 onto the bolt 139 with a spring 140 and a joint washer 141 arranged in between. By tightening the T-nut 142, the base plate 40 connected to the joint plate 136 and the members arranged above the base plate 40 may be integrally pivoted about the bolt 139. That is, the angle of the joint pipe 137 may be inclined to any angle relative to the surface of the base plate 40, and the joint pipe 137 may be adjusted to be parallel relative to the lower pipe 17 of the high hat stand 11. The structure of the lower part of the mounting unit 44 corresponds to a first fastening means of the preferred embodiment.

Figure 8:
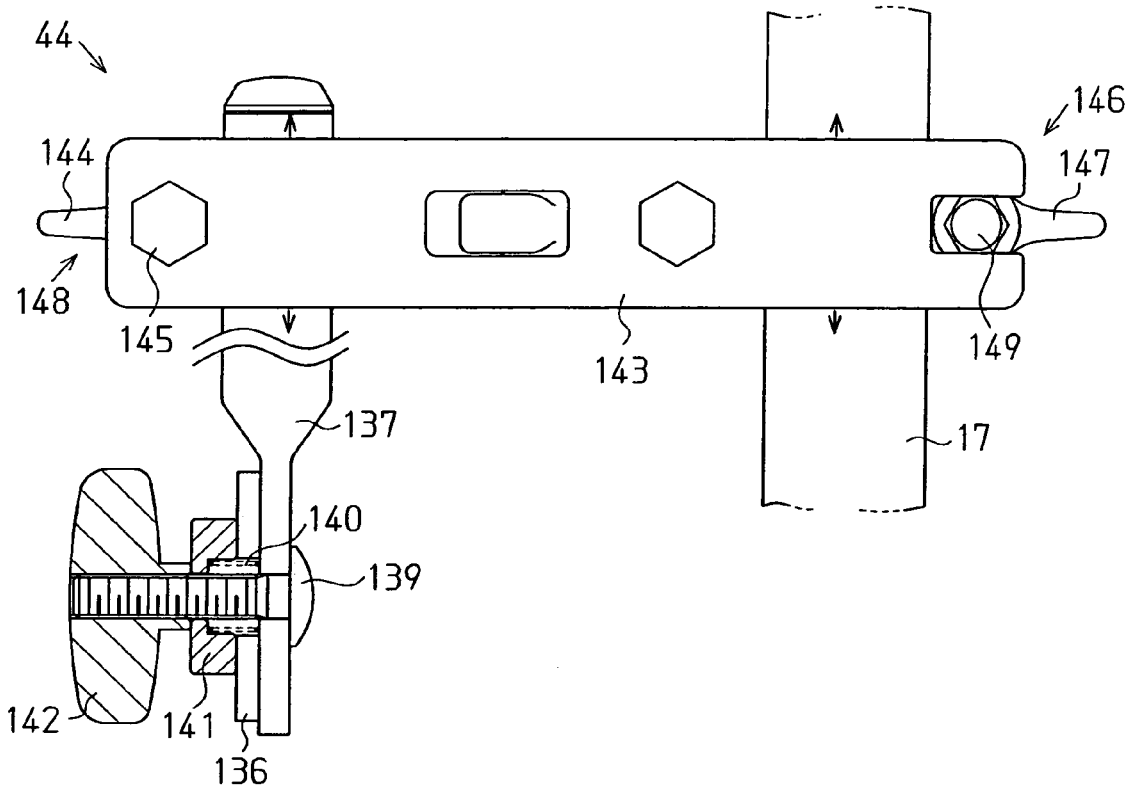
FIG. 8 is a front view showing the mounting unit.
Figure 9:
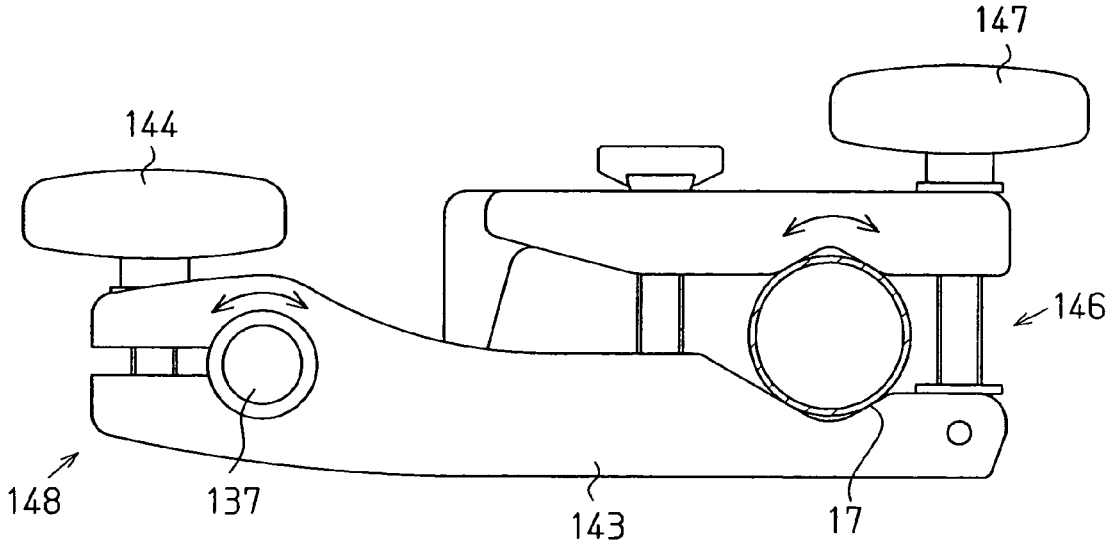
FIG. 9 is a top view showing the mounting unit.

As shown in FIGS. 8 and 9, a multi clamp 143 is assembled on the upper part of the joint pipe 137 by a second fastening mechanism 148, which has a T-nut 144 and a bolt 145. The structure of the second fastening mechanism 148 is substantially similar to the mounting structure including the arm 125 and the slide member 92 in the pedal depressor 126. However, the nut 130 is replaced by a T-nut 144 in the multi clamp 143. Furthermore, the multi clamp 143 is mounted on the lower pipe 17 of the high hat stand 11 by a first fastening mechanism 146, which has a T-nut 147 and bolt 149.

When the lower pipe 17 is held by a bifurcated portion of the multi clamp 143, the lower pipe 17 may be tightened or loosened by rotating the T-nut 147 in the first fastening mechanism 146. That is, the joint pipe 137 and the high hat stand 11 enable easy position adjustment of the pedal locking device 50 (in the front and rear directions) relative to the foot pedal 13 and easy adjustment of the mounting height of the multi clamp 143 with the first fastening mechanism 146 and second fastening mechanism 148. A second fastening means of the present invention is formed by the second fastening mechanism 148 and the multi clamp 143, and a third fastening means of the present invention is formed by the multi clamp 143 and the first fastening mechanism 146.

The assembly method, operation, and method of using the high hat stand 11 and the pedal locking device 50 having the above structure will now be described. First, the assembly method will be described. The pedal locking device 50 is arranged on the side of the high hat stand 11 so as to be adjacent to the foot pedal 13. Then, the T-nut 147 of the first fastening mechanism 146 is adjusted to fix the lower pipe 17 and the joint pipe 137 with the multi clamp 143. When necessary, the T-nuts 144 and 142 may be operated at the second fastening mechanism 148 between the joint pipe 137 and the multi clamp 143 and the connected part of the joint pipe 137 and the joint plate 136 to adjust the position of the pedal locking device 50 and the mounting height position on the high hat stand 11. That is, the pedal locking device 50 provides degrees of freedom regarding rotation in three directions relative to the high hat stand 11 and degrees of freedom relating to vertical movement in two directions. Accordingly, the pedal locking device 50 provides freedom of movement in a total of five directions. In this way, the unlock switch plate 54 and the lock switch plate 55 may be arranged on the left side of the heel rest portion of the foot pedal 13.

The operation and method of using the present invention are described below. When the cymbal unit 15 shown in FIG. 1 is switched from the opened cymbal state to the closed cymbal state, to hold the cymbal unit 15 in the closed cymbal state, the foot pedal 13 is first depressed by the toes to a predetermined low position. This closes the cymbals. Then, with the toes still depressing the foot pedal 13, the heel is shifted to the left side (pedal locking device 50 side) and the lock switch plate 55 is depressed by the heel. This moves the lock switch plate 55 downward in the locking direction, which in turn, rotates the operation shaft 66 in the counterclockwise direction. The rotation of the operation shaft 66 is transmitted to the link mechanism 83. Then, the slide member 92 is lowered by the operation of the link mechanism 83. The movement of the slide member 92 lowers the pedal depressor 126. The bottom surface (bottom surface of the cap 133) of the lowered pedal depressor 126 presses against the foot pedal 13, and the foot pedal 13 is locked in the low position.

Details of the operation of each link of the link mechanism 83 when the foot pedal 13 enters the locked state will now be described below. FIGS. 10(*a*), 10(*b*), and 10(*c*) illustrate the operation of the link mechanism during the locking operation. FIG. 10(*a*) shows the lock release state, FIG. 10(*b*) shows the link mechanism at a dead point, and FIG. 10(*c*) shows the locked state after the passing the dead point. FIGS. 10(*a*), (*b*), and (*c*) show the links arranged at the rear side of the first link 84.

When the operation shaft 66 is rotated, the first link 84 is pivoted in a counterclockwise direction. This further sequentially pivots the fifth link 103 and the second link 85, the sixth link 104 and the third link 89, and the seventh link 105 and the fourth link 91. Since the second end of the seventh link 105 is supported on the frame 81 by a screw 119, the link mechanism is arranged at a dead point when the extension line of the axis (indicated by the broken line in FIG. 10(*b*)) of the seventh link 105 lies along the connection point (the screw 116) of the sixth link 104 and the arm 93.

As shown in FIG. 10(*c*), after the shaft 90 of the fifth link 103 passes by the dead point, an upward force exerted by the coil spring 107 and from the foot pedal 13 (Fs+Fh) acts as a force applied to the seventh link 105 the side at which the pole 106 is located (toward the right of the arrow in the drawing). That is, the force acts in a direction maintaining the locked state, and the lock switch plate 55 is held in the locked state, such that the rubber member 71 presses against the operation base 53. Accordingly, the bottom surface (bottom surface of the cap 133) of the pedal depressor 126 normally rests at the same height, and the foot pedal 13 is normally held at the same low position each time the lock is operated by the locking operation of the lock switch plate 55.

Furthermore, when the lock switch plate 55 is depressed, the rubber member 71 shown in FIG. 4 contacts the contact piece 58 of the unlock switch plate 54, and the contact piece 58 is pressed downward. In this way, after the unlock switch plate 54 is pivoted in a counterclockwise direction, the unlock switch plate 54 stops at a predetermined position. In this state, the rubber member 63 on the bottom surface of the unlock switch plate 54 is separated from the operation base 53. When the lock switch plate 55 is in the locked state, as shown in FIG. 10(*c*), the lock switch plate 55 is flush with the unlock switch plate 54. Accordingly, in this state, when the heel depressing the lock switch plate 55 returns to the pedal 13, there is no interference by the unlock switch plate 54. Furthermore, as shown in FIG. 1, the unlock switch plate 54 is arranged above the heel rest 28 so as to allow easy operation.

The unlocking operation for releasing the locked state of the foot pedal 13 will now be described. The unlocking operation is similar to the locking operation in that it is performed by the heel while depressing the foot pedal 13 with the toes. That is, the heel of the foot depressing the foot pedal 13 is shifted toward the pedal locking device 50, and the unlock switch plate 54 is depressed by the heel. Then, the unlock switch plate 54 is pivoted in the clockwise direction, and the contact piece 58 of the unlock switch plate 54 raises the lock switch plate 55 from below. This pivots the lock switch plate 55 in the clockwise direction.

The clockwise pivoting of the lock switch plate 55 rotates the operation shaft 66 in the same direction. Then, the rotation of the operation shaft 66 is transmitted to the link mechanism 83. The slide member 92 is raised in conjunction with the operation of the various links of the link mechanism 83. Further, the raised slide member 92 raises the pedal depressor 126, which is separated from the foot pedal 13. This releases and unlocks the foot pedal 13 from the low position with the pedal depressor 126 is released. In this state, the foot pedal 13 is depressed and held at the low position but not locked at the low position. Thus, the cymbals remain closed.

The movements of each link during the unlocking operation of the foot pedal 13 is reversed from the movements of the locking operation. That is, when the operation shaft 66 is rotated clockwise when the foot pedal 13 is in a locked state as shown in FIG. 10(*c*), the rotation of the operation shaft 66 first pivots the first link 84. This further sequentially pivots the second link 85 and the fifth link 103, the third link 89 and the sixth link 104, and the fourth link 91 and the seventh link 105. Then, from the locked state shown in FIG. 10(*c*), the shaft 90 passes by the dead point as it moves in a direction opposite to the moving direction of the locking operation. Afterward, the shaft 90 reaches a position located to the left of the screw 119. As a result, the foot pedal 13 is returned to the lock release state shown in FIG. 10(*a*) by the upward force exerted by the coil spring 107.

Even after the foot pedal 13 is released from the locked state in the preferred embodiment, the unlocking operation can be performed while depressing the foot pedal 13 so as that the musician may continue playing with the cymbals in a closed state. However, if the musician wishes, the musician may, of course, open the cymbals state after releasing the lock by directing depressing the unlock switch plate 54 with the toes without depressing the foot pedal 13.

Furthermore, it is also possible to directly depress the lock switch plate 55 without depressing the foot pedal 13 when locking the foot pedal 13. If the lock switch plate 55 is depressed, the pedal depressor 126 automatically depresses the foot pedal 13 as described above.

The preferred embodiment has the advantages described below.

(1) The pedal locking device 50 is mounted on the high hat stand 11 by the mounting unit 44 beside of the high hat stand 11. Further, the operation unit 51 of the pedal locking device 50 is located beside the heel rest portion of the foot pedal 13. Due to this structure, the locking operation for locking the pedal at the low position and the unlocking operation for releasing the pedal from the locked state may be performed with the heel while the foot pedal 13 remains depressed by the toes.

In this way, the cymbals may be held in the closed state with only one foot. Thus, the foot pedal 13 of the cymbals and another pedal, for example a twin bass drum pedal, may be operated simultaneously, which is extremely useful during a performance. That is, once the locking operation has been performed, the cymbal unit 15 is maintained in the closed state even when the foot is removed from the foot pedal 13. This enables the cymbal unit 15 to be played with sticks in the closed state while depressing a further drum pedal.

Furthermore, since the locking and unlocking operations are performed when the foot pedal 13 is depressed, that is, when the cymbals are closed, the movement of the upper movable cymbal 36 is suppressed. This prevents noise of the cymbals when the cymbals are joined from being produced.

(2) The link mechanism 83 is connected to the operation shaft 66, which rotates in a predetermined direction, and the lock switch plate 55 is pivotally connected to the operation shaft 66. The left side of the lock switch plate 55 is held at approximately 65 degrees relative to the base plate 40 when the cymbals are closed. Thus, the lock switch plate 55 may easily be depressed by the heel, and the pedal depressor 126 may contact the foot pedal 13 by means of the operation shaft 66 and the link mechanism 83 through a simple operation. Furthermore, the number of parts is reduced and the structure is simplified because the transmission mechanism for transmitting force and the locking mechanism are formed only by the link mechanism, which uses the link dead point.

(3) The unlock switch plate 54 is pivotally connected to the support shaft 41. That is, the support shaft 41 of the unlock switch plate 54 and the operation shaft 66 of the lock switch plate 55 are provided separately. Thus, the amount of pivoting of the lock switch plate 55 and the amount of pivoting of the unlock switch plate 54 may be set separately. In this way, when performing the unlocking operation, the lock switch plate 55 is arranged at a position where it may be easily depressed, and the unlock switch plate 54 is arranged at a position where it is substantially parallel to the base plate 40 so that it does not cause any interference. After performing the locking operation, the lock switch plate 55 and the unlock switch plate 54 are arranged to be substantially flush with each other so that there is no interference when the heel depressing the lock switch plate 55 is returned. The right side of the unlock switch plate 54 may be arranged above the heel rest 28 of the high hat stand 11 such that the unlock switch plate 54 is easily depressed.

(4) The rotation of the operation shaft 66 moves the slide member 92 and the pedal depressor 126 vertically through the link mechanism 83. By using the link mechanism 83, which includes four links (the first link 84, the second link 85 and the fifth link 103, the third link 89 and the sixth link 104, and the fourth link 91 and the seventh link 105), the locking and unlocking operations are easily performed by depressing each switch plate with a light force. Furthermore, the operation of rotating the operation shaft 66 is smoothly performed when depressing the switch plate, and sufficient sliding distance of the slide member 92 is obtained by a small movement when the switch plate is pivoted.

(5) The pedal locking device 50 is provided with the first fastening mechanism 146, the second fastening mechanism 148, and the fastening portion (T-nut 142 and bolt 139). The first fastening mechanism 146 and the second fastening mechanism 148 are arranged at two locations, which are at the ends of the multi clamp 143 of the mounting unit 44. The fastening portion is located at the bottom of the joint pipe 137. That is, the pedal locking device 50 is mounted such that the position of the pedal locking device 50 relative to the high hat stand 11 is adjustable in the front and rear directions, and the base plate 40 of the pedal locking device 50 may be adjusted without inclining relative to the lower pipe 17 of the high hat stand 11 that is set at any angle. In this way, the pedal locking device 50 may be mounted at any desired position and inclination relative to the lower pipe 17 of the high hat stand 11 that has an inclination. Furthermore, since the T-nuts 144 and 147 adjusted tightness at two locations, which are at the ends of the multi clamp 143, the operation unit 51 is easily positioned beside the heel rest portion of the foot pedal 13. That is, since the pedal locking device 50 is adjustable in a wide range, movable in two directions and pivotal in three directions, it can be easily installed in a desired position even in a structure different from that of the illustrated high hat stand 11.

(6) In the link mechanism 83, four link structures are provided at the front and rear sides of the first link 84, which is commonly used by the links on both sides. That is, symmetrical link mechanisms are provided on opposite sides of the slide member 92. This reduces the force applied to the individual links, and the slide member 92 is stably set so that it is not inclined relative to the pole 106.

(7) A hole for the receiving the shaft 120 is formed on the tip of the arm 93 of the slide member 92. The bushing 121 covers the tip of the arm 93. The buffer 122 and the stopper 123 are arranged above the bushing 121. Thus, the amount of movement of the slide member 92 is adjusted by changing the position at which the stopper 123 is fixed. Furthermore, this allows the position of the lock switch plate 55 to be adjusted in accordance with the amount the musician depresses the pedal.

(8) The pedal depressor 126 is formed by the arm 125, which extends to the side of the slide member 92. The position of the arm 125 may be adjusted to an optional height on the slide member 92. Various heights may be set at the normal height of the foot pedal by adjusting the pedal height of the high hat stand 11 in accordance with the musician and the type of high hat stand 11. The above structure is applicable to such cases since the height at which the arm 125 is mounted on the slide member 92 may be adjusted.

(9) The pedal depressor 126 has the adjustment knob 131 and the adjustment bolt 132. The adjustment bolt 132 is engaged with the screw hole 134 on the tip of the arm 125.

That is, the height of the bottom surface of the pedal depressor 126 may be varied by adjusting the amount of engagement of the female thread of the screw hole 134 and the adjustment bolt 132 with the adjustment knob 131.

Accordingly, the height position maintained when the foot pedal 13 is locked may be finely adjusted. In other words, the pressure applied to the cymbal unit 15 in the closed state may be finely adjusted while maintaining the closed state. When playing the cymbals with sticks, the tonal quality differs depending on the degree of pressure between the lower fixed cymbal 34 and the upper movable cymbal 36. The pressure of the cymbal unit 15 may be adjusted while confirming the tonal quality by rotating the adjustment knob 131 of the pedal depressor 126 to attain the tonal quality desired by the musician. Furthermore, a finely adjusted tonal quality is stably reproduced for each locking operation.

It should be apparent to those skilled in the art that the present invention may be embodied in many other specific forms without departing from the spirit or scope of the invention. Particularly, it should be understood that the present invention may be embodied in the following forms.

Although the pedal locking device 50 is arranged on the left side of the high hat stand 11 in the preferred embodiment, it also may be arranged on the right side. In this case, the lock switch plate 55 is arranged on the right side of the operation shaft 66, and the unlock switch plate 54 is arranged on the left side of the support shaft 41.

Although the link mechanism 83 is provided as a mechanism for converting the rotation of the operation shaft 66 to vertical movement in the preferred embodiment, a cam mechanism may be used in place of the link mechanism 83.

Although two sets of links, each including four types of links (the first link 84, the second link 85 and the fifth link 193, the third link 89 and the sixth link 104, the fourth link 91 and the seventh link 105) are provided in the link mechanism 83 of the preferred embodiment, one set or three or more sets, each including two to three types or five or more types of links, may be used instead.

Although the operation shaft 66 is provided as the rotating shaft of the lock switch plate 55, and the support shaft 41 is provided as the rotating shaft of the unlock switch plate 54 in the preferred embodiment, the operation shaft 66 may be used as a common rotating shaft. In this case, the support shaft 41 is eliminated, and the unlock switch plate 54 is connected to the operation shaft 66, which extends to the rear. In this structure, the lock switch plate 55 and the unlock switch plate 54 are pivoted for the same amount, and the structure is simplified.

Although the rubber members 63 and 71, which function as buffer members, are respectively attached to the bottom surface of the lock switch plate 55 and the unlock switch plate 54 by screws in the preferred embodiment, the rubber members may be attached by an adhesive without using screws.

Although the adjustment knob 131 is provided on the pedal depressor 126 in the preferred embodiment, the knob may be eliminated.

Although the bottom end surface (bottom end surface of the cap 133) of the pedal depressor 126 presses the tip of the foot pedal 13 in the preferred embodiment, the location of the pressure is not limited to the tip. For example, the arm 30 or belt 29 arranged upward from the back end of the foot pedal 13 may be pressed. Furthermore, a new pressing member may be provided on the top surface and the like of the foot pedal 13.

The present examples and embodiments are to be considered as illustrative and not restrictive, and the invention is not to be limited to the details given herein, but may be modified within the scope and equivalence of the appended claims.

The invention claimed is:

1. A pedal locking device installed on a pedal device provided with a pedal switched between a normal position and a low position, which is reached by depressing the pedal downward from the normal position with toes of a foot of a user, the pedal locking device comprising:

a lock switched between a locked state in which the pedal is locked at the low position and an unlocked state in which the pedal is released from the locked state; and a switch including a lock operation unit effective to switch the lock to the locked state and an unlock operation unit for releasing the pedal from the locked, wherein the switch is located beside the pedal to be operable by a heel of the foot, wherein the lock includes:

a pedal depressor effective to switch the pedal between a standby position arranged above the normal pedal position and a lock position effective to lock the pedal at the low position by moving the pedal downward from the standby position; and an operation shaft rotated in a locking direction and an unlocking direction opposite the locking direction to switch the pedal depressor between the standby position and the lock position.

2. The pedal locking device of claim 1, further comprising a mounting member effective to mount the pedal locking device on the pedal device.

3. The pedal locking device of claim 2, wherein the pedal device includes a stand unit, and the mounting member includes:

a base effective to support the switch and the lock;

a support post arranged on the base;

a first fastening member effective to connect the support post to the base;

a second fastening member effective to clamp the support post to an upper portion of the support post; and a third fastening member effective to clamp the second fastening member to the stand unit of the pedal device.

4. The pedal locking device of claim 3, wherein the first fastening member, the second fastening member, and the third fastening member respectively include a female threaded member and a male threaded member engaged with the female threaded member, the engagement of the female threaded member and the male threaded member occurs at a fastening position that is adjustable.

5. The pedal locking device of claim 1, wherein the lock operation unit includes a lock operation plate effective to rotate the operation shaft in the locking direction, and the unlock operation unit includes an unlock operation plate effective to rotate the operation shaft in the unlocking direction.

6. The pedal locking device of claim 5, wherein the unlock operation plate is pivotally supported by a support shaft and operable by a heel, and the unlock operation plate is provided with a contact piece effective to contact the lock operation plate when operated to rotate the operation shaft in the unlocking direction with the lock operation plate.

7. The pedal locking device of claim 1, wherein the lock is provided with a link mechanism effective to transmit the rotation of the operation shaft to the pedal depressor.

8. The pedal locking device of claim 7, further provided with a biasing member effective to bias the pedal toward the normal position, wherein when the pedal is arranged at the low position, the force of the biasing member is applied to the link mechanism to maintain the pedal depressor at the locked position.

9. The pedal locking device of claim 1, wherein the height of the pedal depressor at the locked position is adjustable.

10. A high hat stand including a pedal switched between a normal position and a low position, which is reached by depressing the pedal downward from the normal position with toes of a foot of a user, two cymbals selectively opened and closed in accordance with the depression of the pedal, and a pedal locking device effective to lock the pedal at the low position, the pedal locking device comprising:

a lock switched between a locked state in which the pedal is locked at the low position and an unlocked state in which the pedal is released from the locked state; and a switch including a lock operation unit effective to switch the lock to the locked state and an unlock operation unit for releasing the pedal from the locked state, wherein the switch is located beside the pedal to be operable by a heel of the foot;

wherein the lock includes:

a pedal depressor effective to switch the pedal between a standby position arranged above the normal pedal position and a lock position at which the pedal is locked at the low position by moving the pedal downward from the standby position; and an operation shaft rotated in a locking direction and an unlocking direction opposite the locking direction to switch the pedal depressor between the standby position and the lock position.

11. The high hat stand of claim 10, further comprising a mounting member effective to mount the pedal locking device on the pedal.

12. The high hat stand of claim 11, wherein the pedal includes a stand unit, and the mounting member includes:

a base effective to support the switch and the lock;

a support post arranged on the base;

a first fastening member effective to connect the support post to the base;

a second fastening member effective to clamp the support post to an upper portion of the support post; and a third fastening member effective to clamp the second fastening member to the stand unit of the pedal.

13. The high hat stand of claim 12, wherein the first fastening member, the second fastening member, and the third fastening member respectively include a female threaded member and a male threaded member engaged with the female threaded member, the engagement of the female threaded member and the male threaded member occurs at a fastening position that is adjustable.

14. The high hat stand of claim 10, wherein the lock operation unit includes a lock operation plate effective to rotate the operation shaft in the locking direction, and the unlock operation unit includes an unlock operation plate effective to rotate the operation shaft in the unlocking direction.

15. The high hat stand of claim 14, wherein the unlock operation plate is pivotally supported by a support shaft and operable by a heel, and the unlock operation plate is provided with a contact piece effective to contact the lock operation plate when operated to rotate the operation shaft in the unlocking direction with the lock operation plate.

16. The high hat stand of claim 10, wherein the lock is provided with a link mechanism effective to transmit the rotation of the operation shaft to the pedal depressor.

17. The high hat stand of claim 16, further provided with a biasing member effective to bias the pedal toward the normal position, wherein when the pedal is arranged at the low position, the force of the biasing member is applied to the link mechanism to maintain the pedal depressor at the locked position.

18. The high hat stand of claim 10, wherein the height of the pedal depressor at the locked position is adjustable.

* * * * *